US006547750B2

(12) United States Patent
Huang

(10) Patent No.: US 6,547,750 B2
(45) Date of Patent: Apr. 15, 2003

(54) MASSAGE DEVICE

(76) Inventor: Chu Chua Huang, P.O. Box 26-757, Taipei, 106 (TW)

( * ) Notice: Subject to any disclaimer, the term of this patent is extended or adjusted under 35 U.S.C. 154(b) by 10 days.

(21) Appl. No.: 09/834,705

(22) Filed: Apr. 9, 2001

(65) Prior Publication Data

US 2002/0147418 A1 Oct. 10, 2002

(51) Int. Cl.[7] ..... A61H 7/00

(52) U.S. Cl. ..... 601/137; 601/138; 15/10; 15/186

(58) Field of Search ..... 601/136, 137, 601/138, 17, 109, 111, 110, 227; 15/110, 227, 176.1, 176.4, 176.5, 176.6, 186–188; 132/120

(56) References Cited

U.S. PATENT DOCUMENTS 1,012,653 A * 12/1911 Knickerbocker ..... 601/137
1,518,480 A * 12/1924 Buchanan ..... 15/186
2,090,050 A * 8/1937 Jackson ..... 601/137
3,766,590 A * 10/1973 Wachtel ..... 15/186
3,795,024 A * 3/1974 Weihrauch ..... 15/176.1
4,249,521 A * 2/1981 Gueret ..... 15/110
4,343,265 A * 8/1982 Belschner ..... 601/137
4,409,967 A * 10/1983 Gueret ..... 601/137
4,463,485 A * 8/1984 Gueret ..... 601/137
5,095,892 A * 3/1992 Tsumura ..... 601/137
5,285,774 A * 2/1994 Stachursji ..... 601/137
5,673,455 A * 10/1997 Per-Lee et al. ..... 601/137
6,098,233 A * 8/2000 Chen ..... 601/138

FOREIGN PATENT DOCUMENTS

DE 2341440 A1 * 2/1975 ..... 601/137
FR 969087 A * 12/1950 ..... 601/137
GB 2019220 A * 10/1979 ..... 601/137

* cited by examiner

*Primary Examiner*—Nicholas D. Lucchesi
*Assistant Examiner*—Quang D Thanh
(74) *Attorney, Agent, or Firm*—Rosenberg, Klein & Lee

(57) ABSTRACT

A massage device includes a housing, a connecting unit and an elastomer. The bottom of the housing is installed with an inner wall. The inner wall of the housing corresponds to the outer wall of the connecting unit to couple the connecting unit to the housing. Furthermore, the inner wall of the connecting unit is installed with a trench, and a plurality of through holes that communicate with the trench. The outer edge of the elastomer is installed in the trench of the connecting unit so that the elastomer protrudes from the bottom of the housing. Glue fills the through holes so as to achieve a better combination.

10 Claims, 7 Drawing Sheets

MASSAGE DEVICE

FIELD OF THE INVENTION

The present invention relates to a massage device, and especially to a massage device having a firmly secured combining structure and an improved massage effect.

BACKGROUND OF THE INVENTION

Referring to FIG. 1, the prior massage device 1*a* includes a holdable rod 10*a*. The distal end of the rod 10*a* is installed to the top surface of the housing 11*a*. The bottom of the housing 11*a* is installed with a hollow recess 12*a*. The outer edge of the recess 12*a* is formed with an annular gluing portion 13*a*. The inner lateral side of the gluing portion 13*a* near the recess 12*a* is stuck to an outer edge of an elastomer 14*a* by glue (not shown) so that the elastomer 14*a* may protrude out and adhere to the bottom of the housing 1*a*. A plurality of spaced arranged apertures 15*a* are installed on the elastomer 14*a*. Each aperture 15*a* is installed with a protrusion 16*a*. The protrusion 16*a* allows the massage device 1*a* to have the effect of a massage.

However, since the elastomer 14*a* is only stuck to the inner surface of gluing portion 13*a* by glue (not shown) and after prolonged use, the outer edge of the elastomer 14*a* is easily separated from the gluing portion 13*a* due to a press force, and thus, loosening the structure. Moreover, in manufacturing the massage device, the elastomer 14*a* and the gluing portion 13*a* are combined by surface contact and excess glue (not shown) may flow out so as to affect the outlook of the product. Furthermore, a poor massage effect may occur since the elastomer 14*a* and the glue 13*a* are combined.

SUMMARY OF THE INVENTION

Accordingly, the primary objective of the present invention is to provide a massage device with a tight structure. The elastomer will not separate from the housing over prolonged use. Moreover, glue will not flow from the device so as to sustain a beautiful appearance.

Another objective of the present invention is to provide a massage device with an elastomer having a stronger structure for a preferred massage effect.

A further objective of the present invention is to provide a massage device which can be assembled easily and conveniently so that the products can be diversified and produced rapidly.

To achieve the aforesaid objectives, the present invention provides a massage device including a housing, a connecting unit and an elastomer. The bottom of the housing is installed with an inner wall. The inner wall of the housing corresponds to the outer wall of the connecting unit to coupled the connecting unit to the housing. Furthermore, the inner wall of the connecting unit is installed with a trench, and a plurality of through holes. The through holes communicate with the trench. The outer edge of the elastomer is installed in the trench of the connecting unit in order for the elastomer to protrude from the bottom of the housing. Glue fills the through holes so as to achieve a better combination.

The present invention also provides a massage device, wherein the trench of the connecting unit is formed with an opening. A bending portion is installed at the opening near the inner wall of the connecting unit, and the bending portion is inwardly reduced so that the bottom of the inner wall of the connecting unit is bent inwards. This gives the elastomer a stronger structure so as to present a preferred massage effect.

The present invention provides a massage device, wherein the bottom of the housing has a hollow recess. The inner wall of the recess is formed with an annular groove. An annular tilt surface is installed on the outer wall of the connecting unit. The tile surface will cause the outer edge of the groove to enlarge gradually along the tilted surface of the connecting unit as the housing and the connecting unit are engaged until the connecting unit is buckled. Therefore, the connecting unit and the housing can be rapidly and conveniently buckled so that the product can be produced rapidly.

DETAILED DESCRIPTION OF THE PREFERRED EMBODIMENTS

The various objectives and advantages of the present invention will be more readily understood from the following detailed description when read in conjunction with the appended drawings.

Figure 1:
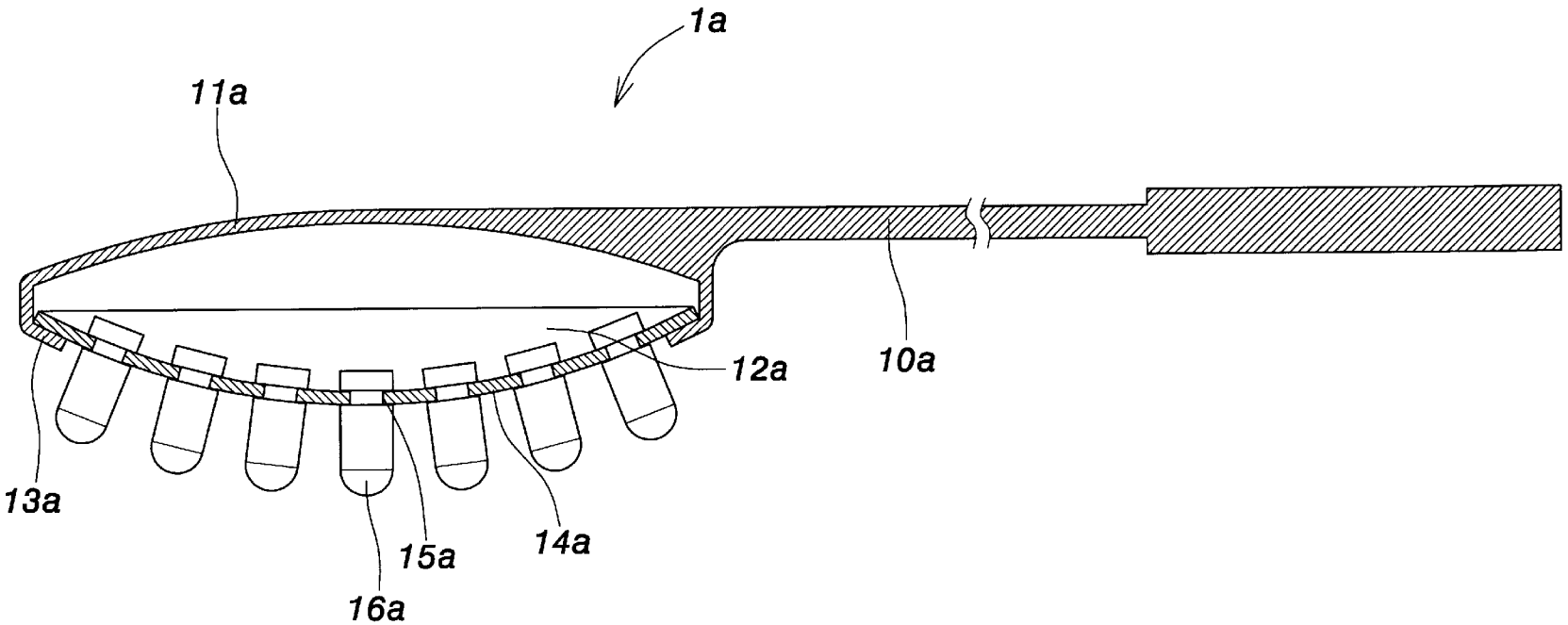
FIG. 1 PRIOR ART
FIG. 1 is a schematic cross sectional view of a prior massage device.
Figure 2:
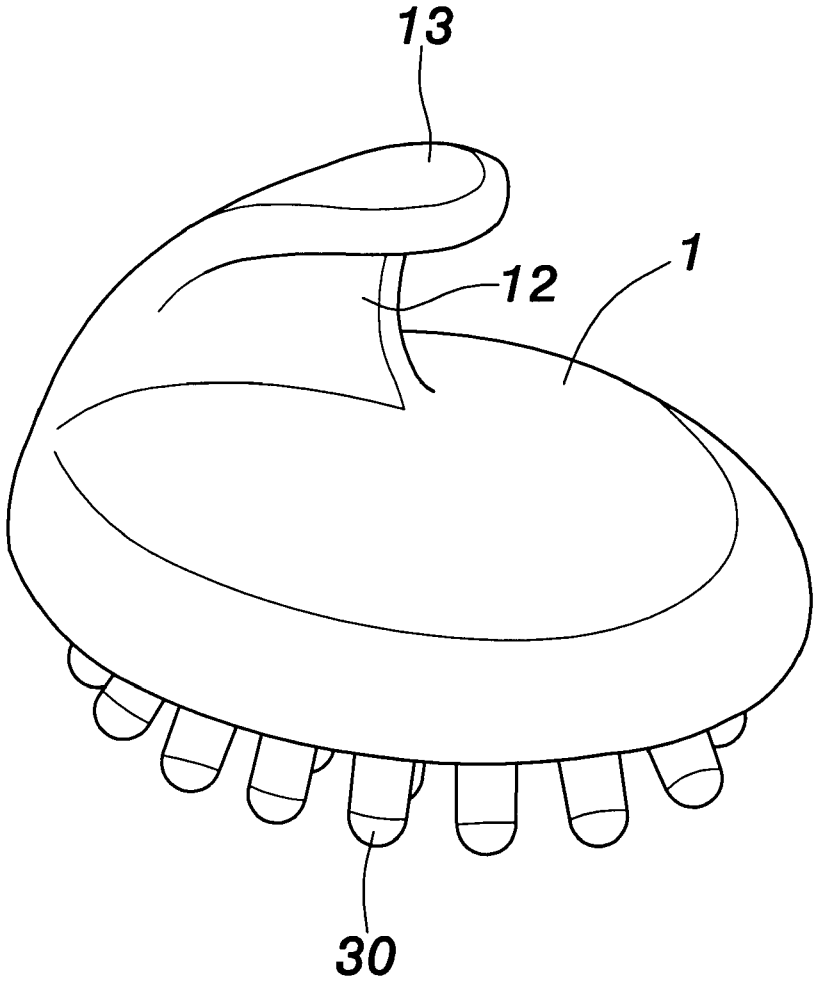
FIG. 2 is a schematic perspective view of the present invention.
Figure 3:
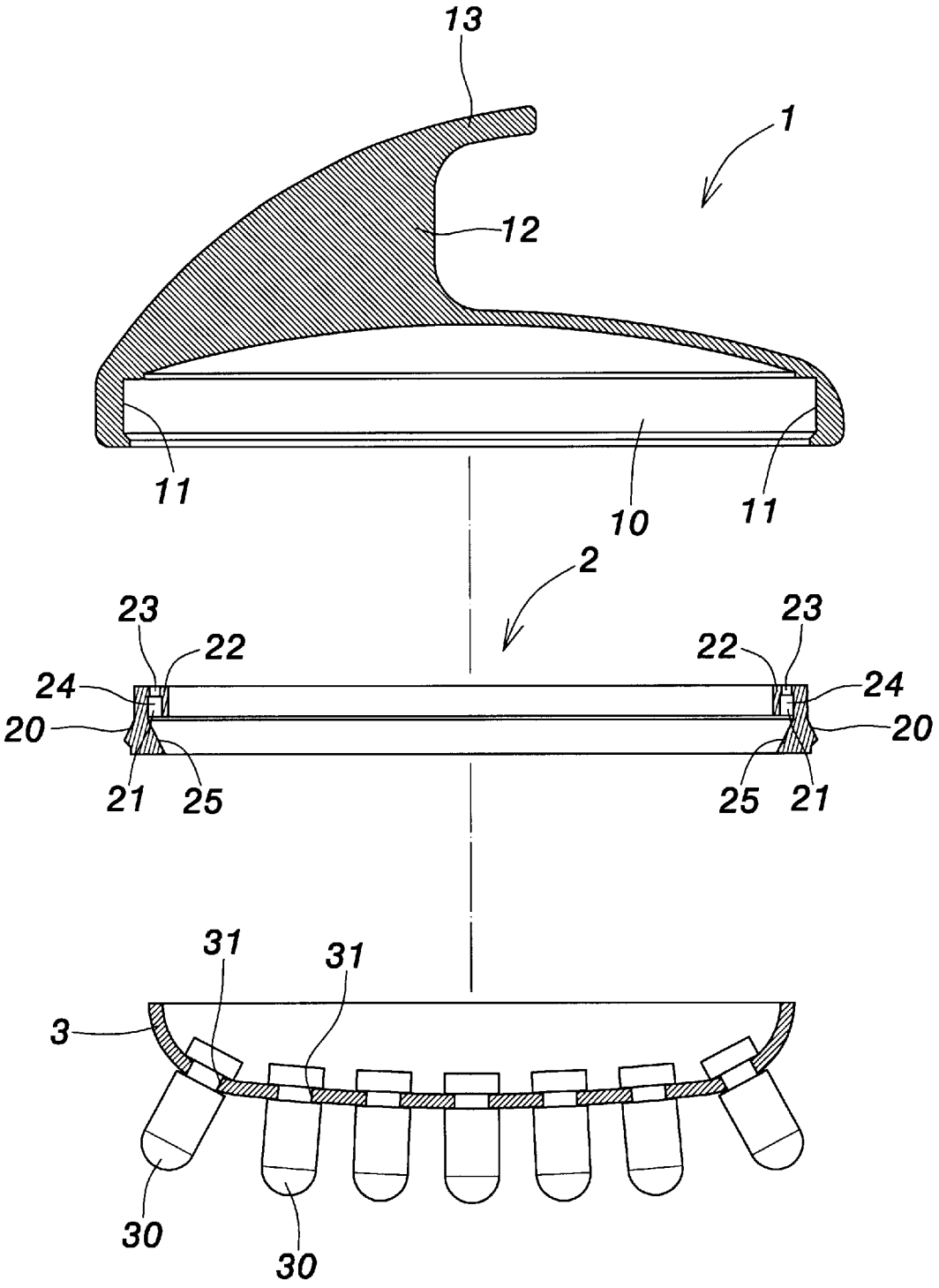
FIG. 3 is an exploded cross sectional view of the present invention.
Figure 4:
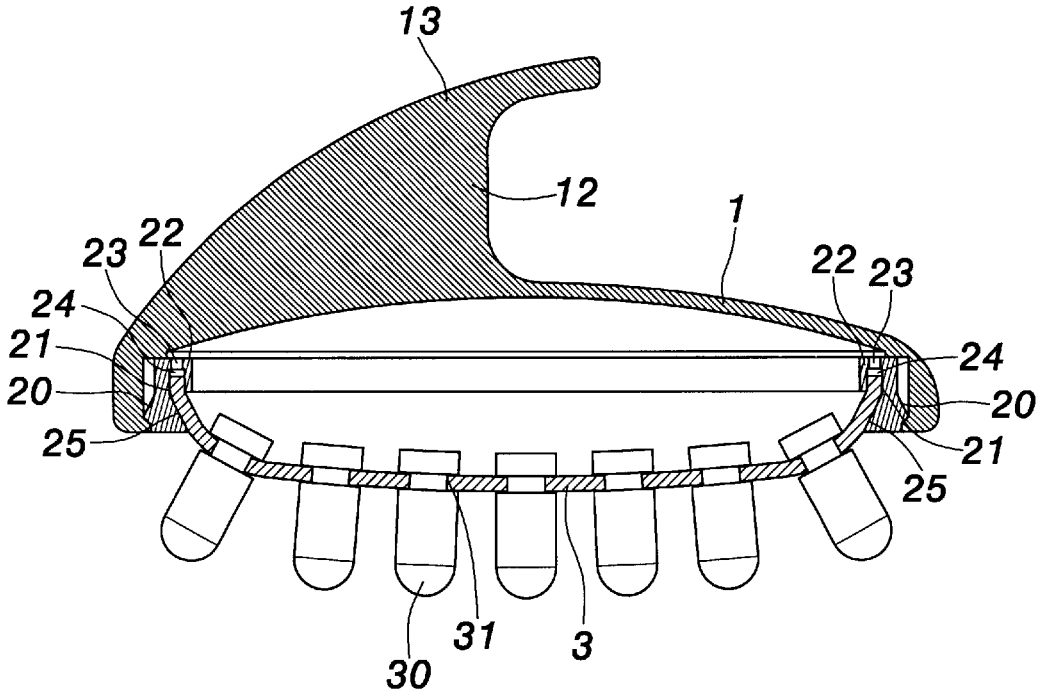
FIG. 4 is an assembled cross sectional view of the present invention.
Figure 6:
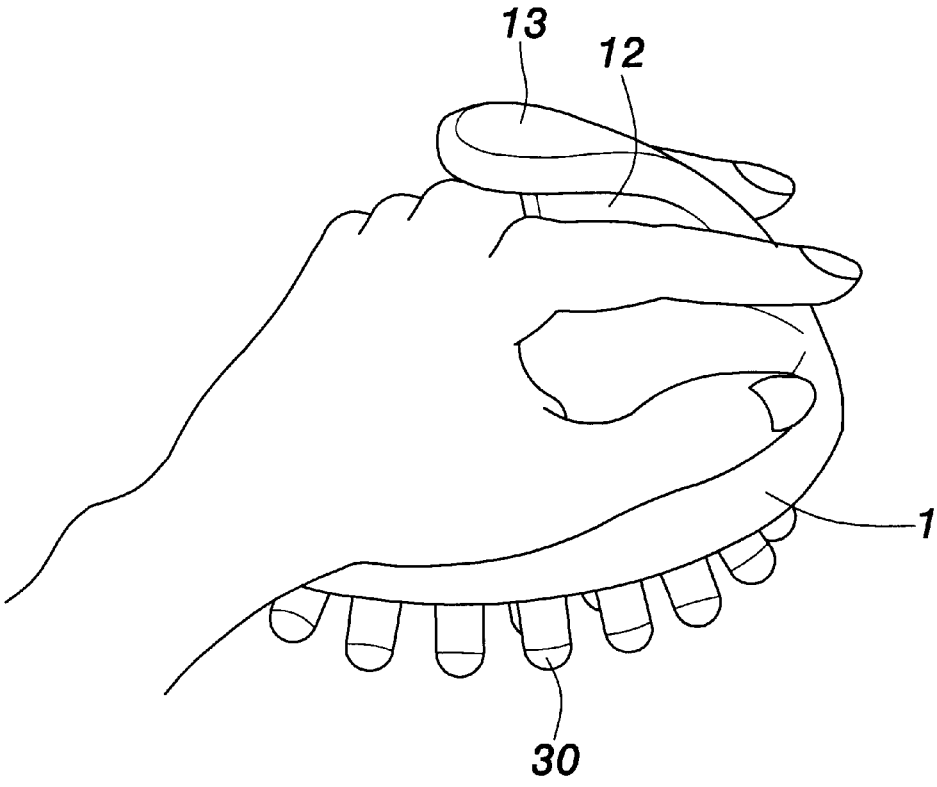
FIG. 6 is a schematic view showing the use of the present invention.
Figure 7:
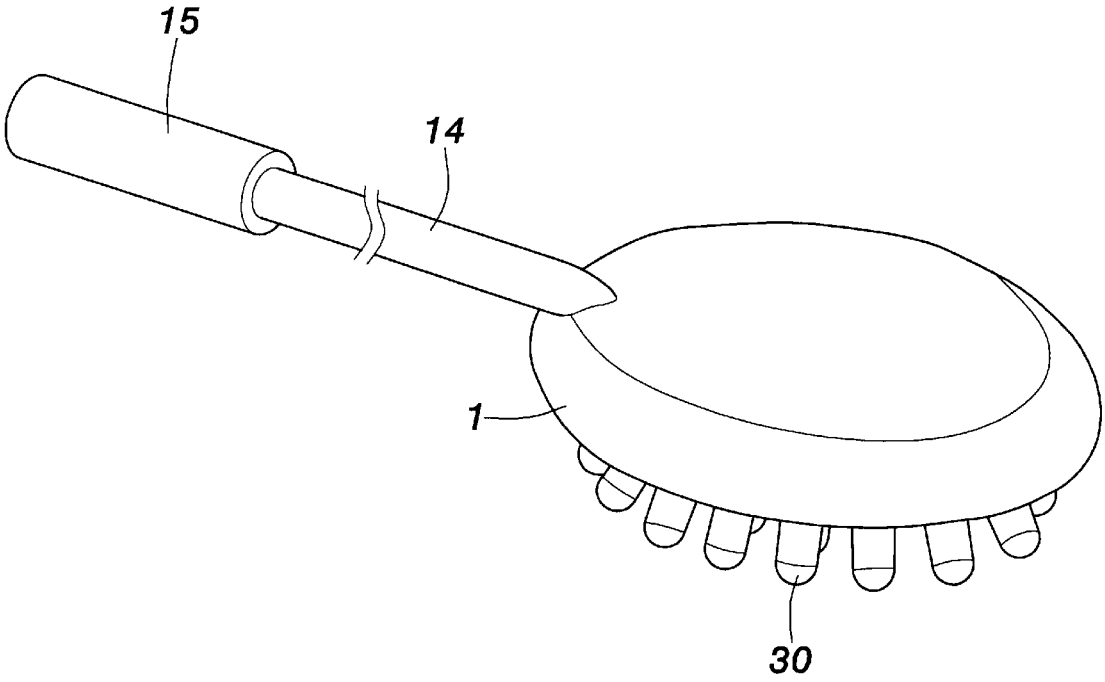
FIG. 7 is a schematic perspective view of another embodiment in the present invention.

Referring to FIGS. 2, 3 and 4, the schematic perspective view, exploded cross sectional view, and assembled cross sectional view of the present invention are illustrated. The massage device of the present invention includes a housing 1, a connecting unit 2, and an elastomer 3. The lower end of the housing 1 is installed with a hollow recess 10. The inner wall of the recess 10 is installed with a circular groove 11. Furthermore, the top surface of the housing 1 is formed as a shape (not shown) to be held by a hand matching the required ergonomics. Referring to FIG. 6, the top of the housing 1 is installed with a dual use of a sheet 12 capable of being clamped by two fingers. The top of the sheet 12 is integrally formed with a vertical top portion 13. Therefore, by clamping the two fingers or holding in the hand, the massage device can be held steadily so as to prevent the massage device from sliding. Furthermore, a rod 14 can be installed (referring to FIG. 7). One end of the rod 14 is connected to the surface of the housing 1, while another end thereof contains a holding portion 15 for the hand.

Figure 5:
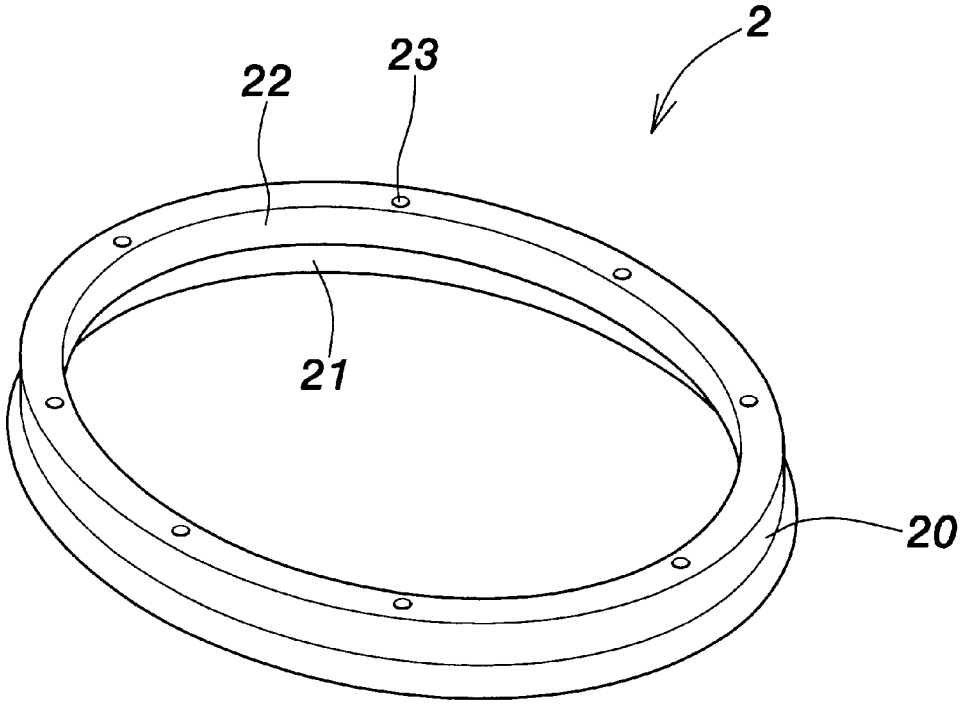
FIG. 5 is a schematic perspective view of the connecting unit in the present invention.

Referring to FIG. 5, the connecting unit 2 has an annular body having an outer wall 20 and an inner wall 21. The outer wall 20 of the connecting unit 2 corresponds to the groove 11 of the housing 1 so that the connecting unit 2 will steadily buckle to the lower edge of the housing 1. Alternaively, the outer wall 20 of the connecting unit 2 may be connected to the recess 10 by adhering with glue (not shown) or other adhesives. Therefore, it is unnecessary to form the groove 11 in the inner wall of the recess 10. Additionally, the connecting unit 2 can be formed as a round annular body, and the outer thread (not shown) can be installed to the outer wall 20 of the connecting unit 2. Furthermore, the inner thread 20 (not shown) corresponding to the outer thread can be installed to the inner wall of the recess 10, steadily securing the housing 1 to the connecting unit 2.

Moreover, the inner wall 21 of the connecting unit 2 is installed with an annular trench 22, and a plurality of through holes 23 communicating with the trench 22. An opening 24 is installed in the trench 22. The bending portion 25 extend downwards and is formed at the opening 24 near the inner wall 21 of the connecting unit 2. The bending portion 25 is reduced inwards so that the lower edge of the inner wall 21 of the connecting unit 2 bends inwards.

The elastomer 3 is an elastic piece made of resilient material, such as rubber and other soft material. The lower end of the elastomer 3 is formed with a plurality of protrusions 30. The protrusions 30 are integrally formed with the elastomer 3 (not shown). A plurality of apertures 31 is formed on the elastomer 3 and the protrusions 30 pass through respective apertures 31. Furthermore, the outer edge of the elastomer 3 is installed in the trench 22 of the connecting unit 2. The elastomer 3 can be clamped to the connecting unit 2 by the trench 22 and protrudes from the lower edge of the housing 1 so that the protrusions 30 are expanded. Glue (not shown) is filled into the through holes 23 of the connecting unit 2 to tightly connect the elastomer 3 with the connecting unit 2.

Referring to FIGS. 3 and 4, in assembling the present invention, the outer edge of the elastomer 3 is installed in the trench 22 of the connecting unit 2 and glue (not shown) is filled into the trench 22 of the through holes 23, so that the elastomer 3 and the connecting unit 2 are tightly connected by the glue (not shown). Thus, the elastomer 3 is preferably combined with the connecting unit 2. The outer edge of the elastomer 3 will not separate with the connecting unit 2 due to a press force. Since the outer edge of the elastomer 3 is installed in the trench 22 to seal the opening 24, the sticky glue (not shown) will not flow out, and thus, the beautiful appearance will not be affected. Moreover, since the connecting unit 2 is installed with a bending portion 25, the bottom of the elastomer 3 tightly abuts the inner wall 21 of the connecting unit 2. Thus the elastomer 3 is enhanced to increase the massage effect.

The connecting unit 2 is installed at the lower end of the housing 1. The connecting unit 2 is buckled to the recess 10 of the housing 1. However, the connecting unit 2 can be rapidly and conveniently buckled to the housing 1 since the outer wall 20 of the connecting unit 2 is formed with a downward expanded annular surface (referring to FIG. 3). Therefore, the tilted surface at the outer edge of the groove 11 along the outer wall 20 of the connecting unit 2 is gradually enlarged until the connecting unit 2 is buckled. Therefore, by the aforesaid structure, the massage device of the present invention is formed.

Furthermore, the massage device of the present invention can be diversified and produced rapidly due to the following reasons. The housing 1 and the connecting unit 2 can be buckled rapidly, and thus after the specifications of the connecting unit 2 and the elastomer 3 are determined, the housing 1 of various shapes (referring to FIGS. 6 and 7) are made. Therefore, the assembling work is easily and rapidly performed.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A massage device comprising:

a housing having a recess formed in a bottom surface thereof;

a connecting unit disposed in said recess of said housing and having an annular body, said connecting unit including an inner wall and an outer wall, said inner wall having a trench formed therein and a plurality of through holes formed therethrough, said through holes being in open communication with said trench, said outer wall engaging an inner wall of said recess of said housing; and, an elastomer projecting from a lower edge of said housing and having a plurality of protrusions disposed on a lower portion thereof, said elastomer having an outer edge received in said trench of said connecting unit, said trench receiving glue therein through said through holes of said connecting unit to fixedly secure said elastomer to said connecting unit.

2. The massage device as claimed in claim 1, wherein an upper surface of said housing is formed ergonomically with a shape corresponding to a hand of a user.

3. The massage device as claimed in claim 1, wherein said housing includes a top portion having a finger gripping member.

4. The massage device as claimed in claim 1, wherein said housing is connected to a rod having a holding portion.

5. The massage device as claimed in claim 1, wherein said inner wall of said recess of said housing is fixedly secured to said outer wall of said connecting unit by an adhesive.

6. The massage device as claimed in claim 1, wherein said inner wall of said recess of said housing includes a groove formed therein, said groove having a contour corresponding to a contour of said outer wall of said connecting unit to connect said connecting unit to said housing.

7. The massage device as claimed in claim 1, wherein said outer wall of said connecting unit includes a downward expanding tilt surface.

8. The massage device as claimed in claim 1, wherein said outer wall of said connecting unit includes an outer thread and said inner wall of said recess of said housing includes a corresponding inner thread to connect said connecting unit to said housing.

9. The massage device as claimed in claim 1, wherein said connecting unit includes a bending portion, said trench of said connecting unit having an opening formed adjacent said bending portion, said bending portion being inwardly reduced to allow said lower edge of said inner wall to bend inwardly.

10. The massage device as claimed in claim 1, wherein said protrusions of said elastomer are integrally formed thereon.

* * * * *